US007405642B1

(12) United States Patent
Hsu et al.

(10) Patent No.: US 7,405,642 B1
(45) Date of Patent: Jul. 29, 2008

(54) THREE DIMENSIONAL TRANSFORMER

(75) Inventors: Heng-Ming Hsu, Taichung (TW); Kuo-Hsun Huang, Taichung (TW)

(73) Assignee: United Microelectronics Corp., Hsinchu (TW)

( * ) Notice: Subject to any disclaimer, the term of this patent is extended or adjusted under 35 U.S.C. 154(b) by 0 days.

(21) Appl. No.: 11/684,232

(22) Filed: Mar. 9, 2007

(51) Int. Cl.
*H01F 5/00* (2006.01)

(52) U.S. Cl. ..... 336/200; 336/223; 336/232

(58) Field of Classification Search ..... 336/200, 336/223, 232
See application file for complete search history.

(56) References Cited

U.S. PATENT DOCUMENTS

| | | | | |
|---|---|---|---|---|
| 6,559,751 | B2 * | 5/2003 | Liu et al. | 336/223 |
| 6,927,664 | B2 * | 8/2005 | Nakatani et al. | 336/200 |
| 6,992,366 | B2 | 1/2006 | Kim et al. | |
| 7,091,814 | B2 * | 8/2006 | Kyriazidou | 336/200 |
| 7,262,680 | B2 * | 8/2007 | Wang | 336/200 |
| 2005/0024176 | A1 * | 2/2005 | Wang et al. | 336/200 |
| 2006/0176136 | A1 | 8/2006 | Weon et al. | |

OTHER PUBLICATIONS

Article titled "Implementation of Perfect-Magnetic-Coupling Ultralow-Loss Transformer in RFCMOS Technology" authored by Yo-Sheng Lin, IEEE Electron Device Letters. vol. 26, No. 11, Nov. 2005. (pp. 832-835).

* cited by examiner

*Primary Examiner*—Anh T Mai
(74) *Attorney, Agent, or Firm*—J.C. Patents

(57) ABSTRACT

A three dimensional (3D) transformer includes a first coil and a second coil. Each coil includes a first port, a second port, a top layer metal line, inter-layer inner metal lines, inter-layer outer metal lines and a bottom layer metal line. Each metal line of the first coil and that of the second coil are correspondingly arranged to the opposite side of each other. Each of the first port is electrically connected to each of the top metal line. Each coil is arranged clockwise from the top metal line, the inter layer inner metal line down to the bottom layer metal line and arranged clockwise from the bottom layer metal line, the inter layer outer metal line up to the upper metal line of the inter layer outer metal line. Each upper metal line of the inter layer outer metal line is electrically connected to each second port.

11 Claims, 3 Drawing Sheets

THREE DIMENSIONAL TRANSFORMER

BACKGROUND OF THE INVENTION

1. Field of Invention

The present invention relates to a radio frequency integrated circuits. More particularly, the present invention relates to a three dimensional (3D) transformer.

2. Description of Related Art

In recent years, the demand for radio frequency integrated circuits has increased significantly due the popularity and convenience of wireless communication. In the design of complementary metal oxide semiconductor (CMOS) radio frequency integrated circuits, the inductor is a very important device to be considered asides from controlling the high frequency property of the active device. Since a CMOS substrate is a highly consumed substrate, managing the property of the inductor is difficult. In the conventional CMOS radio frequency integrated circuits, the inductor is configured on the planar structure of the GaAs circuit. The area of the planar structure of the GaAs circuit is large; thus, the area of the radio frequency integrated circuits becomes correspondingly large and the cost is ultimately increased.

The transformer is also a relevant device in the radio frequency integrated circuits. Many recent studies have focused on replacing the inductor with a transformer Not only such layout can better preserve the chip area, a low consumption of voltage can be achieved. Along with the miniaturization the micromation of devices, the traditional planar type of transformer, which occupies a large area, fails to conform to current demands.

SUMMARY OF THE INVENTION

The present invention is to provide a three dimensional (3D) transformer in which the coupling rate is enhanced, while the chip area is preserved.

The present invention is to provide a 3D transformer, which includes a first coil, and a second coil, and each coil includes a first port, a second port, a top-layer metal line, a plurality of inter-layer inner metal lines, a plurality of inter-layer outer metal lines and a bottom-layer metal line. Each metal line of the first coil and each metal line of the second coil are correspondingly arranged to an opposite side of each other. Each of the first port is connected to each of the top-layer metal line of each coil. Further, each coil is arranged from the top-layer metal line, to the inter layer inner metal line and down to the bottom-layer metal line in one direction, and is arranged from the bottom layer metal line, to the inter-layer outer metal line and up to the upper layer metal line of the inter-layer outer metal line in the same one direction to connect with each second port.

According to an embodiment of the present invention of a 3-D transformer, the above direction is a clockwise direction.

According to an embodiment of the present invention of a 3-D transformer, the above direction is a counter clockwise direction.

According to an embodiment of the present invention of a 3-D transformer, the length of the first coil is substantially the same as that of the second coil.

According to an embodiment of the present invention of a 3-D transformer, the length of the first coil of each layer is substantially the same as that of the second coil.

According to an embodiment of the present invention of a 3-D transformer, the length of the first coil is proportional to that of the second coil.

According to an embodiment of the present invention of a 3-D transformer, the width of the first coil is substantially the same as that of the second coil.

According to an embodiment of the present invention of a 3-D transformer, the material of the first coil is the same as the material of the second coil.

According to an embodiment of the present invention of a 3-D transformer, the material of the first coil is different from that of the second coil.

The distance between the inter-layer outer metal line and the inter-layer inner metal line of each layer of the first coil is substantially the same as the distance between the inter-layer outer metal line and the inter-layer inner metal line of each layer of the second coil.

According to an embodiment of the present invention of a 3-D transformer, the distance between each layer of the metal line of the first coil and each layer of the metal line of the second coil is substantially the same.

According to an embodiment of the present invention of a 3-D transformer, the coupling rate is enhanced and the chip area is preserved.

In order to make the aforementioned and other objects, features and advantages of the present invention comprehensible, a preferred embodiment accompanied with figures is described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
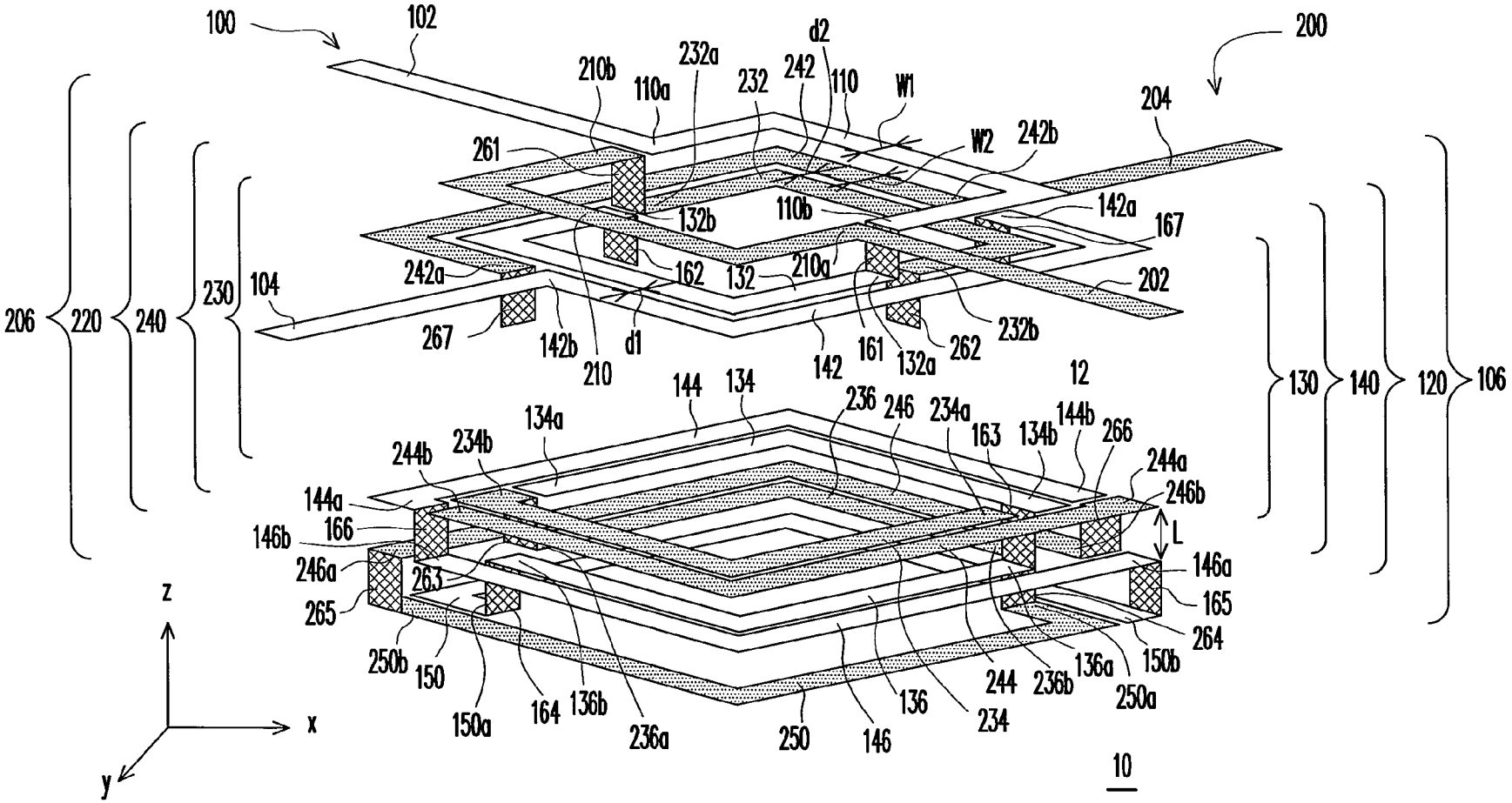
FIG. 1 is a schematic, cross-sectional view of a three dimensional (3-D) transformer according to an embodiment of the present invention.
Figure 2:
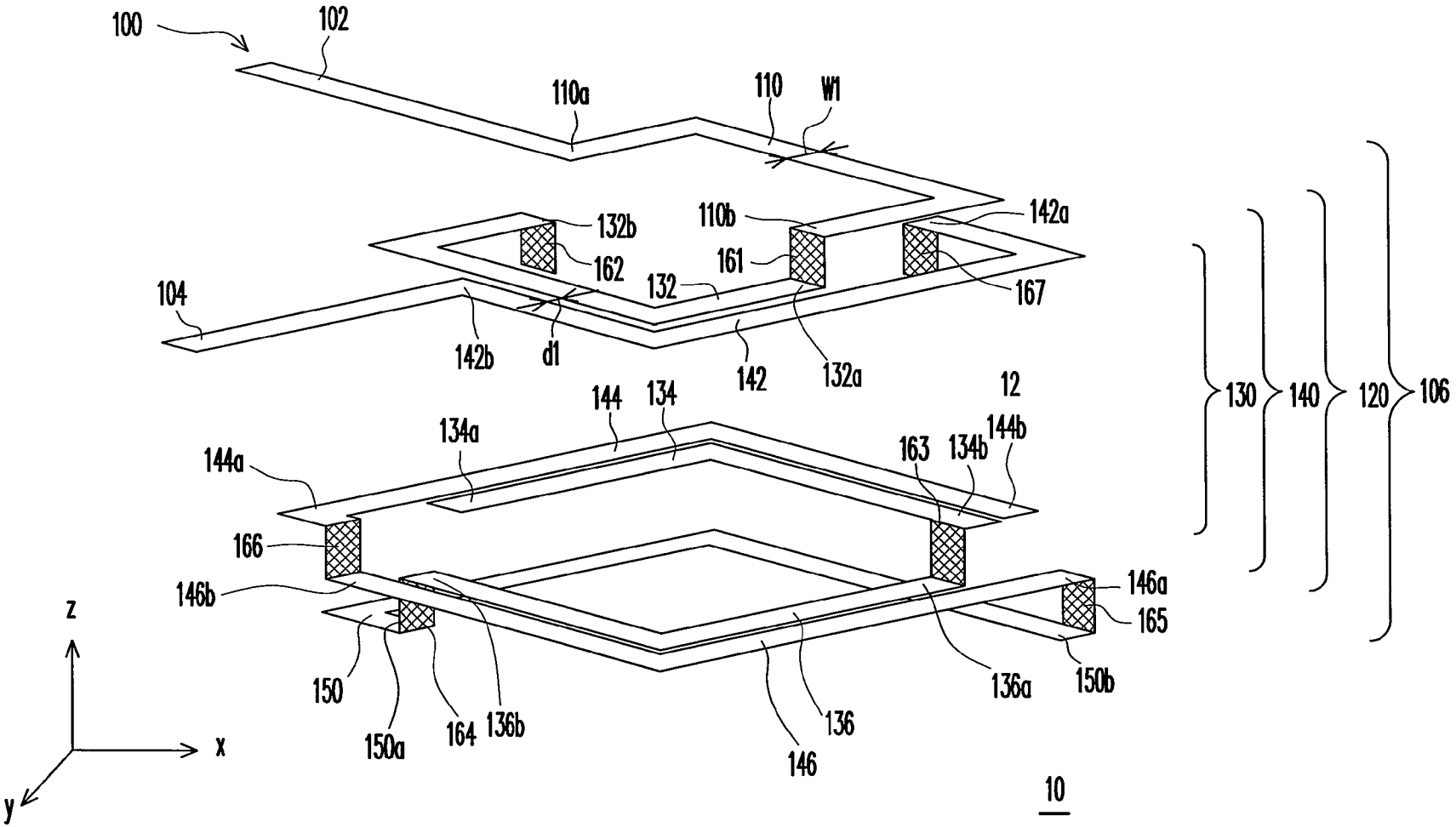
FIG. 2 is a schematic, cross-sectional view of a first coil of a three dimensional transformer according to an embodiment of the present invention.
Figure 3:
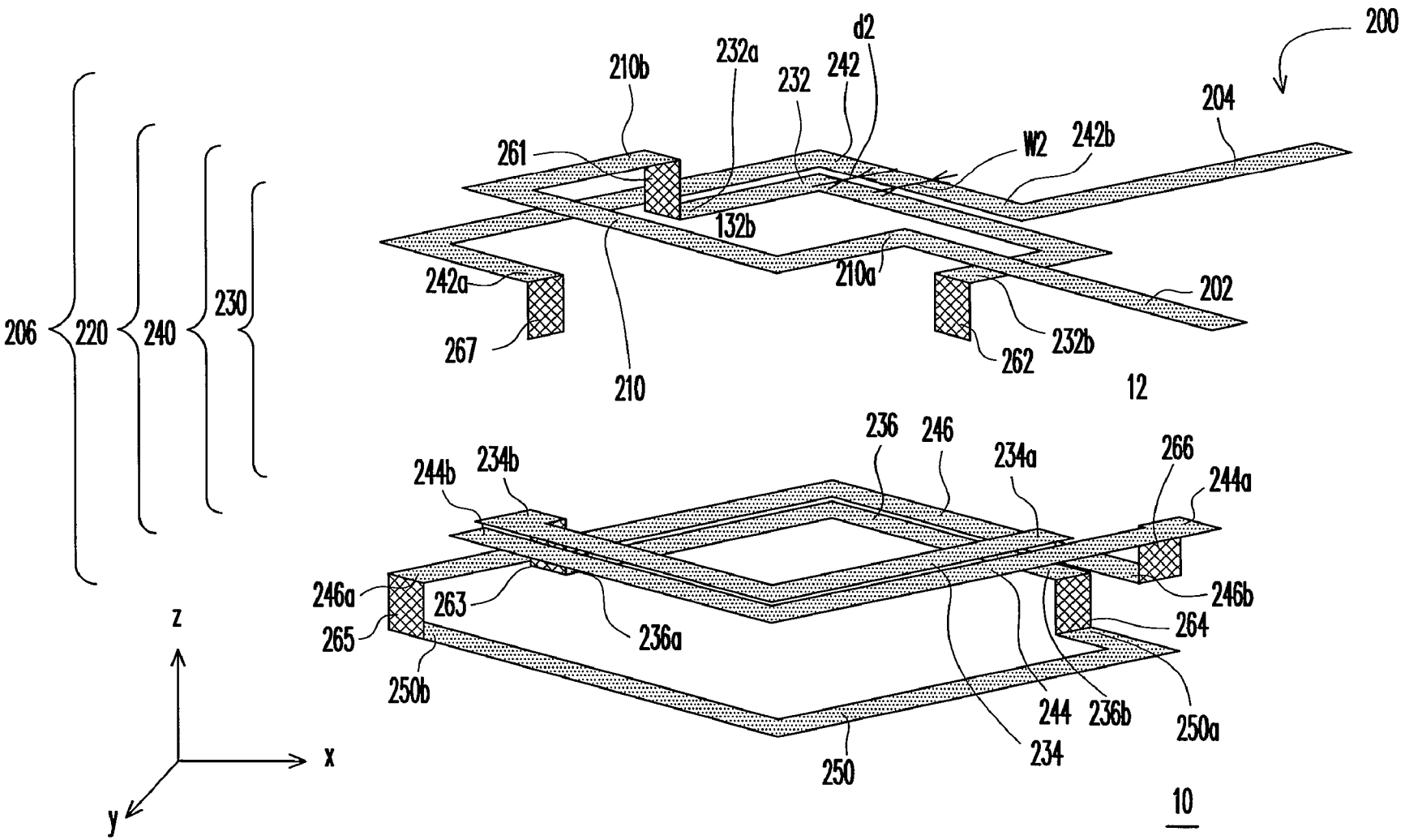
FIG. 3 is a schematic, cross-sectional view of a second coil of a three dimensional transformer according to an embodiment of the present invention.

FIG. 1 is a schematic, cross-sectional view of a three dimensional (3-D) transformer according to an embodiment of the present invention. FIG. 2 is a schematic, cross-sectional view of a first coil of a three dimensional transformer according to an embodiment of the present invention. FIG. 3 is a schematic, cross-sectional view of a second coil of a three dimensional transformer according to an embodiment of the present invention.

Referring to FIG. 1, the 3-D transformer 10 of the present embodiment is disposed on a semiconductor substrate 10, wherein the 3-D transformer 10 includes a first coil 100 and a second coil 200.

Referring to FIGS. 1 and 2, the first coil 100 includes a first port 102, a second port 104 and a plurality of first metal lines 106. The plurality of the first metal lines 106 include a top layer first metal line 110, a plurality of inter-layer first metal lines 120 and a bottom layer first metal line 150. The layers of metal lines are insulated from each other with a dielectric layer 12, for example, silicon oxide.

Referring to FIG. 2, in the first coil 100, the first end 110*a* of the top layer first metal line 110 and the first port 102 are connected, while the second end 110*b* is electrically connected to the plurality of inter-layer first metal lines 120 through the via plug 161.

Referring to FIG. 2, in the first coil 100, each inter-layer first metal line 120 respectively includes an inner first metal line 130 and an outer first metal line 140. The first end 132*a* of the top-most layer of the inner first metal line 132 of the inter-layer first metal line 120 is connected to the second end 110*b* of the top layer first metal line 110 through the via plug 161, while the second end 132*b* is electrically connected to the inner first metal line 134 of the layer below through the via plug 162. The first end 136*a* of the most-bottom layer of the inner first metal line 136 of the inter-layer first metal 130 is electrically connected with the inner first metal line 134 of the layer above through the via plug 163, while in the second end 136*b* is electrically connected with the first end 150*a* of bottom layer the first metal line 150 through the metal plug 164.

Referring to FIG. 2, in the first coil 210, the first end 146*a* of the most-bottom layer of the outer first metal line 146 of the inter-layer first metal line 120 is electrically connected with the second end 150*b* of the bottom layer first metal line 150, wherein the second end 146*b* is electrically connected with the outer first metal line 144 of the layer above through the via plug 166. The first end of the top-most layer of the outer first metal line 142 of the inter-layer first metal line 120 is electrically connected with the outer first metal line 144 of the layer below through the metal plug 167, wherein the second end 142*b* and the second port are connected.

Referring to FIGS. 1 and 3, the second coil 200 includes a first port 202, a second port 204 and a plurality of second metal lines 206. The multi layers of the second metal lines 206 include a top layer second metal line 210, a plurality of the inter-layer second metal lines 220 and a bottom layer second metal line 250, which are insulated from each other with a dielectric layer, for example silicon-oxide.

Referring to FIG. 3, in the second coil 200, the first end 210*a* of the top layer second metal line 210 and the first port 202 are connected, while the second end 210*b* is electrically connected to the inter-layer second metal line 220 through the via plug 261.

Referring to FIG. 3, in the second coil 200, each inter-layer second metal line 220 respectively includes an inner second metal line 230 and an outer second metal line 240. The first end 232*a* of the top-most layer of the inner second metal line 232 of the inter-layer second metal line 220 is connected with the second end 210*b* of the top layer second metal line 210 through the via plug 261, while the second end 232*b* is electrically connected with the inner second metal line 234 below through the via plug 262. The first end 236*a* of the bottom-most layer of the imler second metal line 236 of the inter-layer second metal line 220 is electrically connected with the inner second metal line 234 of the layer above, while the second end 236*b* is electrically connected with the first end of the second metal line 250 through the via plug 264.

Referring to FIG. 3, in the second coil 200, the first end 246*a* of the bottom-most layer of the outer second metal line 246 of the inter-layer second metal line 220 is electrically connected with the second end 250*b* of the bottom layer second metal line 250 through the via plug 265, while the second end 246*b* is electrically connected with the outer second metal line 244 of the layer above through the via plug 266. The first end 242*a* of the top-most outer second metal line 242 of the inter-layer second metal line 220 is electrically connected with the lower layer of the outer second metal line 244 through the via plug 267, while the second end 242*b* is connected to the second port 202.

Referring to FIG. 1, each layer of the metal lines 106 of the first coil 100 and each layer of the metal lines 206 of the second coil 200 are correspondingly configured to the opposite side of each other. Each coil 100/200 uses the respective first port 102/202 to connect with the top layer metal line 110/210, and each coil is arranged from the first end 150*a*/250*a* of the top layer metal line 110/210, to the inner metal lines 132/232, 134/234, 136/236 down to the bottom metal line 150/250 in a direction. Further, each coil 100/200 is arranged from the second end 150*b*/250*b* of the bottom layer metal line 150/250, to the outer metal lines 146/246, 144/244 up to the top-most outer metal line 142/242 of the inter-layer metal line 120/220 in the same direction. Further, the top-most outer metal line 142/242 is respectively connected to the second port 104/204.

The first coil 100 and the second coil 200 of the 3-D transformer illustrated in FIG. 1 are respectively wound down in a clockwise direction and wound up in the same clockwise direction. In another embodiment, the first coil 100 and the second coil 200 of the 3-D transformer are respectively wound down in a counter clockwise direction and then wound up in the counter clockwise direction.

According to the 3-D transformer of the present embodiment of the invention, along an x-y plane, first coil 100 and the second coil 200 of each layer are correspondingly arranged to the opposite side of each other. Along the Z-direction, the first coil 100 and the second coil 200 are alternately stacked. Therefore, not only the first coil 100 and the second coil can be coupled along the x-y plane, they can be coupled in the z-direction to further improve the coupling rate. Experimental results confirm that the coupling rate can be above 90%.

According to the 3-D transformer of the present embodiment of the invention, the length of the metal line of the first coil 100 of each layer and that of the second coil 200 are substantially the same. The lengths of the via plugs 161 to 167 and 261 to 267 are also substantially the same. Accordingly, the length of the first coil 100 and that of the second coil are substantially the same. In another embodiment, the total length of the first coil 100 is proportional to the total length of the second coil 200. For example, the ratio of the total length of the first coil with respect to the total length of the second coil is 1:2, 1:3, 1:4 or higher.

According to the 3-D transformer of the present embodiment of the invention, the width W1 of each metal line of the first coil 110 is substantially equal to the width W2 of each metal line of the second coil 200. The distance L between each layer of the metal lines can be the same or different. Further, the distance d1 between the outer first metal line 140 of each layer of the first coil 100 and the inner first metal line 130 is substantially equal to the distance d2 between the outer second metal line 240 of each layer of the second coil 200 and the inner second metal line 230. However, it should be appreciated that the present invention is not limited to the dimensions and distances disclosed above.

According to the 3-D transformer of the present embodiment of the invention, the material constituting the first coil 100 and the material constituting the second coil can be the same or different, for example, a conductive material such as copper or aluminum.

According to the 3-D transformer of the present embodiment of the invention, the coil is constructed with a total of 5 metal layers. However, it should be appreciated that the number of metal layers of the invention is not limited to 5 layers. The number of metal layers of each coil or the total number of metal layers of the integrated circuits can vary according to the implementation requirements.

According to the 3-D transformer of the present invention, the coupling rate is enhanced and the metal layers of the integrated circuits are effectively applied to preserve the chip area. Further, the fabrication of the 3-D transformer of the present invention is compatible with the fabrication of the integrated circuits to simplify the manufacturing process.

Additionally, the transformer of the present invention is applicable in the radio frequency integrated circuits for the manufacturing of low noise amplifier and voltage controlled oscillator, etc.

The present invention has been disclosed above in the preferred embodiments, but is not limited to those. It is known to persons skilled in the art that some modifications and innovations may be made without departing from the spirit and scope of the present invention. Therefore, the scope of the present invention should be defined by the following claims.

What is claimed is:

1. A three dimensional (3-D) transformer comprising:

a first coil and a second coil that are insulated from each other, each coil comprising a first port, a second port, a top layer metal line, a plurality of inter-layer inner metal lines, a plurality of inter-layer outer metal lines and a bottom layer metal line, wherein each layer of the metal lines of the first coil and each layer of the metal lines of the second coil are correspondingly configured to an opposite side of each other, and the first port of each coil is connected to the top layer metal line of the coil, and each coil is arranged, in the same spiral direction, from a first end of the top layer metal line of the coil to the inner metal lines of the coil and down to the bottom layer metal line of the coil and then from a second end of the bottom layer metal line of the coil up to a top-most layer of the outer metal lines of the coil and then to the second port of the coil.

2. The three dimensional (3-D) transformer of claim 1, wherein the spiral direction is a clockwise direction.

3. The three dimensional (3-D) transformer of claim 1, wherein the spiral direction is a counter clockwise direction.

4. The three dimensional (3-D) transformer of claim 1, wherein a length of the first coil is substantially the same as a length of the second coil.

5. The three dimensional (3-D) transformer of claim 4, wherein the length of the first coil of each layer is substantially the same as the length of the second coil of each layer.

6. The three dimensional (3-D) transformer of claim 1, wherein a length of the first coil is proportional to a length of the second coil.

7. The three dimensional (3-D) transformer of claim 1, wherein a width of the first coil is substantially the same as a width of the second coil.

8. The three dimensional (3-D) transformer of claim 1, wherein a material of the first coil is substantially the same as a material of the second coil.

9. The three dimensional (3-D) transformer of claim 1, wherein a material of the first coil is different from a material of the second coil.

10. The three dimensional (3-D) transformer of claim 1, wherein a distance between the inter-layer outer metal lines of each layer of the first coil and the inter-layer inner metal lines is substantially the same as a distance between the inter-layer outer metal lines of the second coil and the inter-layer inner metal lines.

11. The three dimensional (3-D) transformer of claim 1, wherein a distance between each layer of the metal lines of the first coil and a distance between each layer of the metal lines of the second coil are substantially the same.

* * * * *